US008960882B2

(12) United States Patent
Denda et al.

(10) Patent No.: US 8,960,882 B2
(45) **Date of Patent: *Feb. 24, 2015**

(54) INK JET RECORDING METHOD, INK SET, AND RECORDED ARTICLE

(75) Inventors: Atsushi Denda, Chino (JP); Tsuyoshi Sano, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 393 days.

This patent is subject to a terminal disclaimer.

(21) Appl. No.: 13/435,473

(22) Filed: Mar. 30, 2012

(65) Prior Publication Data

US 2012/0249668 A1 Oct. 4, 2012

(30) Foreign Application Priority Data

Mar. 30, 2011 (JP) ..... 2011-075824

(51) Int. Cl.

| | |
|---|---|
| ***B41J 2/01*** | (2006.01) |
| ***B41M 5/00*** | (2006.01) |
| ***B41J 2/21*** | (2006.01) |
| ***B41M 7/00*** | (2006.01) |

(52) U.S. Cl.

CPC ..... *B41M 5/0023* (2013.01); *B41J 2/01* (2013.01); *B41J 2/2107* (2013.01); *B41M 7/0036* (2013.01)

USPC ..... 347/100; 347/95; 347/96; 347/105

(58) Field of Classification Search

CPC ..... B41J 2/01; B41J 2/211; B41J 2/1433; B41J 2/17; B41J 2/17593; B41J 2/2107; B41J 2/1755; B41J 2/2114; B41J 11/0015; B41J 2/2056; B41J 2/21; C09D 11/36; C09D 11/40; C09D 11/30; C09D 11/38; C09D 11/322; C09D 11/328; C09D 11/101; C09D 11/005; C09D 11/54; C09D 11/52; B41M 5/0011; B41M 5/0017; B41M 7/00

USPC ..... 347/100, 95, 105, 96

See application file for complete search history.

(56) References Cited

U.S. PATENT DOCUMENTS

| | | | | |
|---|---|---|---|---|
| 5,104,730 | A | 4/1992 | Misuda et al. | |
| 5,407,600 | A | 4/1995 | Ando et al. | |
| 6,857,733 | B2 | 2/2005 | Issler | |
| 7,121,660 | B2 | 10/2006 | Ide et al. | |
| 7,615,266 | B2 | 11/2009 | Kinoshita et al. | |
| 8,118,401 | B2 | 2/2012 | Yoshida | |
| 8,814,297 | B2 | 8/2014 | Usuda et al. | |
| 2007/0076069 | A1 * | 4/2007 | Edwards et al. | 347/100 |

(Continued)

FOREIGN PATENT DOCUMENTS

| | | | |
|---|---|---|---|
| JP | 05-024824 | A | 2/1993 |
| JP | 7-121609 | A | 5/1995 |

(Continued)

*Primary Examiner* — Manish S Shah

(74) *Attorney, Agent, or Firm* — Nutter McClennen & Fish LLP; John J. Penny, Jr.; Taylor M. Coon

(57) ABSTRACT

An ink jet recording method includes forming a glittering image on a recording medium by ejecting a glittering ink containing silver onto the recording medium by an ink jet method, applying a protective ink containing a resin and substantially no coloring material onto the glittering image, and forming a color image by ejecting a color ink containing a coloring material to the glittering image by an ink jet method. The protective ink is applied between the glittering image and the color image.

14 Claims, 4 Drawing Sheets

(56) References Cited

U.S. PATENT DOCUMENTS

| | | | | |
|---|---|---|---|---|
| 2008/0145628 | A1 | 6/2008 | Oyanagi et al. | |
| 2009/0142519 | A1 | 6/2009 | Nagai et al. | |
| 2011/0221807 | A1 | 9/2011 | Yoshida | |
| 2011/0228003 | A1* | 9/2011 | Ozawa | 347/44 |
| 2012/0038702 | A1* | 2/2012 | Kagata et al. | 347/20 |
| 2012/0040155 | A1* | 2/2012 | Komatsu et al. | 428/204 |
| 2012/0249668 | A1 | 10/2012 | Denda et al. | |
| 2012/0287200 | A1 | 11/2012 | Yano et al. | |
| 2013/0108841 | A1 | 5/2013 | Denda et al. | |
| 2013/0182057 | A1 | 7/2013 | Koase | |
| 2013/0201231 | A1* | 8/2013 | Usuda et al. | 347/9 |

FOREIGN PATENT DOCUMENTS

| | | | |
|---|---|---|---|
| JP | 08-150800 | A | 6/1996 |
| JP | 10-000850 | A | 1/1998 |
| JP | 2002-086892 | A | 3/2002 |
| JP | 2004-122496 | A | 4/2004 |
| JP | 2004-122505 | A | 4/2004 |
| JP | 2005-081422 | A | 3/2005 |
| JP | 2005-532924 | A | 11/2005 |
| JP | 2006-263951 | A | 10/2006 |
| JP | 2008174712 | A | 7/2008 |
| JP | 2010-052244 | A | 3/2010 |
| JP | 2011-183677 | A | 9/2011 |
| WO | 2007-043713 | A | 4/2007 |

* cited by examiner

INK JET RECORDING METHOD, INK SET, AND RECORDED ARTICLE

BACKGROUND

1. Technical Field

The present invention relates to an ink jet recording method, an ink set, and a recorded article.

2. Related Art

The demand for recorded articles having glittering images formed on the recording surface thereof is increasing. To form a glittering image, a foil pressing method may be performed by pressing a metal foil on a highly flat recording surface, or a metal or the like may be deposited on a plastic film having a smooth recording surface by vacuum vapor deposition. Also, a glittering pigment ink may be applied onto a recording medium, followed by pressing. These recording methods can produce recorded articles having relatively high glitter. However, in order to record glittering images in a recorded article, press molds or recording masks having the same shapes as glittering image patterns are prepared in advance, and, in addition, the process time for forming such a recorded article is increased. Accordingly, some techniques, as disclosed in JP-A-2008-174712, have been proposed which record glittering images by an ink jet method, which can perform on-demand recording at a low cost.

For an ink jet recording method achieving multicolor recording as in conventional methods, image quality as high as that produced by color photography, and increasing recording speed, many techniques have been proposed for inks improved in color developability, multicolor recording and weather fastness, and for recording media, particularly ink receiving layers, for achieving stable fixing of color materials, improving weather fastness, achieving high absorption of ink solvent (for example, JP-A-2006-263951, Japanese Patent Application No. 2005-300274, and JP-B-7-121609).

Ink receiving layers used in ink jet recording media are generally classified into two types: porous type that absorbs the ink solvent in the physical pores therein while fine silica or alumina particles having particle sizes of several tens of nanometers to several hundreds of nanometers are fixed on a base material with an organic binder; and wet type that absorbs the ink solvent in such a manner that water-soluble polymer, such as polyvinyl pyrrolidone, polyvinyl alcohol, cellulose, or urethane, fixed on a base material is wetted by the solvent. Both types contain a cationic color-fixing material that can fix coloring materials in inks to the ink receiving layer. Cationic color-fixing materials are generally classified into cation-modified polymers and cationic hydrated metal compounds. Cationic hydrated metal compounds are widely used because they are easy in handling and stable to light and environmental gases. For example, aluminum chloride-based cationic fixing materials are preferably used in practice which include chlorine as an anion component that will be released in the course of ink absorption, and aluminum hydroxide as a cation component that will be released in the course of the ink absorption, as disclosed in, for example, JP-A-2006-263951, Japanese Patent Application No. 2005-081422, and JP-A-2002-86892.

When chlorine contained as an impurity in recording media is considered, there are many recording media that contain chlorine as an impurity. For example, some recording media may contain an aluminum chloride-based fixing material, on purpose, in order to achieve high fixability. In other recording media, the ink receiving layer may contain involuntarily chlorine that has been used as an additive in the course of preparing fine alumina particles used for an ink receiving layer (for example, in the course of the process for preparing alumina disclosed in JP-A-5-24824). Also, chlorine is generally used for bleaching pulp, raw material of paper, and accordingly, recording media often contain chlorine as an impurity.

Although the chlorine content in a recording medium has a wide range from ppm order to about 1%, depending on the case where chlorine is added on purpose or on the case where it is involuntarily added, quality problems of inks, such as discoloration and degradation in light fastness, have not been caused by chlorine because chlorine does not react with coloring materials generally used in ink jet inks, that is, dyes and pigments for reproducing cyan, magenta, yellow, black and other colors.

However, it has been found that if an aqueous ink containing silver particles as a glittering material is used on chlorine-containing recording media, much superior metallic gloss can appears immediately after recording, but the image, or the gloss, of the recorded article is significantly degraded by light, relative to the cases where known color inks (cyan, magenta, yellow, block, etc.) are used. It has also been found that the gloss is noticeably degraded in colored glittering image areas (hereinafter referred to as metallic color image area).

The inventors investigated the reason why the gloss is degraded by light, and found that the following phenomena degrade the gloss of recorded articles.

When an image is formed with an aqueous ink containing silver particles, free chlorine is released and dissolved in the solvent, or water, of the ink. The free chlorine may be released from the above-described aluminum chloride-based cationic fixing agent or the impurity in the recording medium. It is generally known that chlorine and silver, irrespective of whether or not they are in ions, react directly with each other to form silver chloride. Part of the silver particles used as a glittering pigment is formed into silver chloride.

It is considered that the silver chloride formed in a recording medium is sensitive to UV light, as is clear from the fact that it is usefully used as photosensitive material in silver halide photographic films. The silver chloride formed in the recording medium is sensitized by light and forms coarse recrystallized silver on most of the surface of the recording medium, but the process of this reaction is not described in detail. The coarse recrystallized silver scatters visible light at the surface of the medium. This is the reason why light degrades the gloss of recording media.

In addition, it has been found that the photosensitivity of silver chloride, which is sensitized to produce silver by UV light having a wavelength of about 370 nm or less, is increased by contact with coloring materials contained in color inks (cyan, magenta and yellow inks), but the reason is not clear. This is the reason why gloss decrease is noticeably caused at portions where metallic color images are recorded.

SUMMARY

An advantage of some aspects of the invention is that it provides an ink jet recording method and an ink set that can record (form) highly glittering (glossy) images with light fastness even on a recording medium containing chlorine, and provides a recorded article including an image having high glitter and light fastness.

Accordingly, the present invention has been made to solve at least part of the above issues, and the following embodiments of the invention can be provided.

Application 1

According to an aspect of the invention, an ink jet recording method is provided. In the ink jet recording method, a glittering image is formed on a recording medium by ejecting a glittering ink containing silver by an ink jet method, and a protective ink containing a resin and substantially no coloring material is applied to the glittering image. Also, a color image is formed by ejecting a color ink containing a coloring material to the glittering image by an ink jet method. The protective ink is applied between the glittering image and the color image.

This method can produce recorded articles superior in light fastness and having high metallic gloss and good design.

Application 2

In the ink jet recording method, the applying of the protective ink may be performed after the completion of the forming of the glittering image.

Thus, the method can produce recorded articles superior in light fastness and having high metallic gloss and good design.

Application 3

In the ink jet recording method, the applying of the protective ink may be performed before the forming of the color image.

Thus, the method can produce recorded articles particularly superior in light fastness and having high metallic gloss and good design.

Application 4

The amount of the protective ink applied may be varied depending on the coloring material in the color ink.

Thus, the method can produce recorded articles superior in light fastness and having metallic gloss superior in color reproduction range.

Application 5

The resin in the protective ink may be at least one selected from among urethane resins and fluorene resins.

This method can produce recorded articles superior in light fastness and having high metallic gloss and good design.

Application 6

The glittering ink may contain 2% to 50% by mass of the silver, and has a surface tension S of 20 mN/m≤S≤40 mN/m and a viscosity V of 1.5 Pa·s≤V≤10 Pa·s.

Such a glittering ink can increase the metallic gloss of images and can be stably ejected. Consequently, the variation in light fastness can be reduced, and the ink can be advantageously used in processes for producing recorded articles by an ink jet method.

Application 7

In the ink jet recording method, the recording medium may contain chlorine.

In this instance, the glittering material and the coloring material can be firmly fixed to the recoding medium, and consequently, the resulting recorded article can exhibit particularly high glitter and color developability.

Application 8

According to another aspect of the invention, a recorded article produced by the above-described ink jet recording method is provided.

This recorded article has particularly high glitter, color developability, and light fastness.

BRIEF DESCRIPTION OF THE DRAWINGS

The invention will be described with reference to the accompanying drawings, wherein like numbers reference like elements.

DESCRIPTION OF EXEMPLARY EMBODIMENTS

Preferred embodiments of the invention will now be described in detail.

Ink Jet Recording Apparatus

Prior to the description of embodiments of the invention, an ink jet apparatus (liquid-ejecting apparatus) used in the ink jet recording method according to the embodiments will be described.

Figure 1:
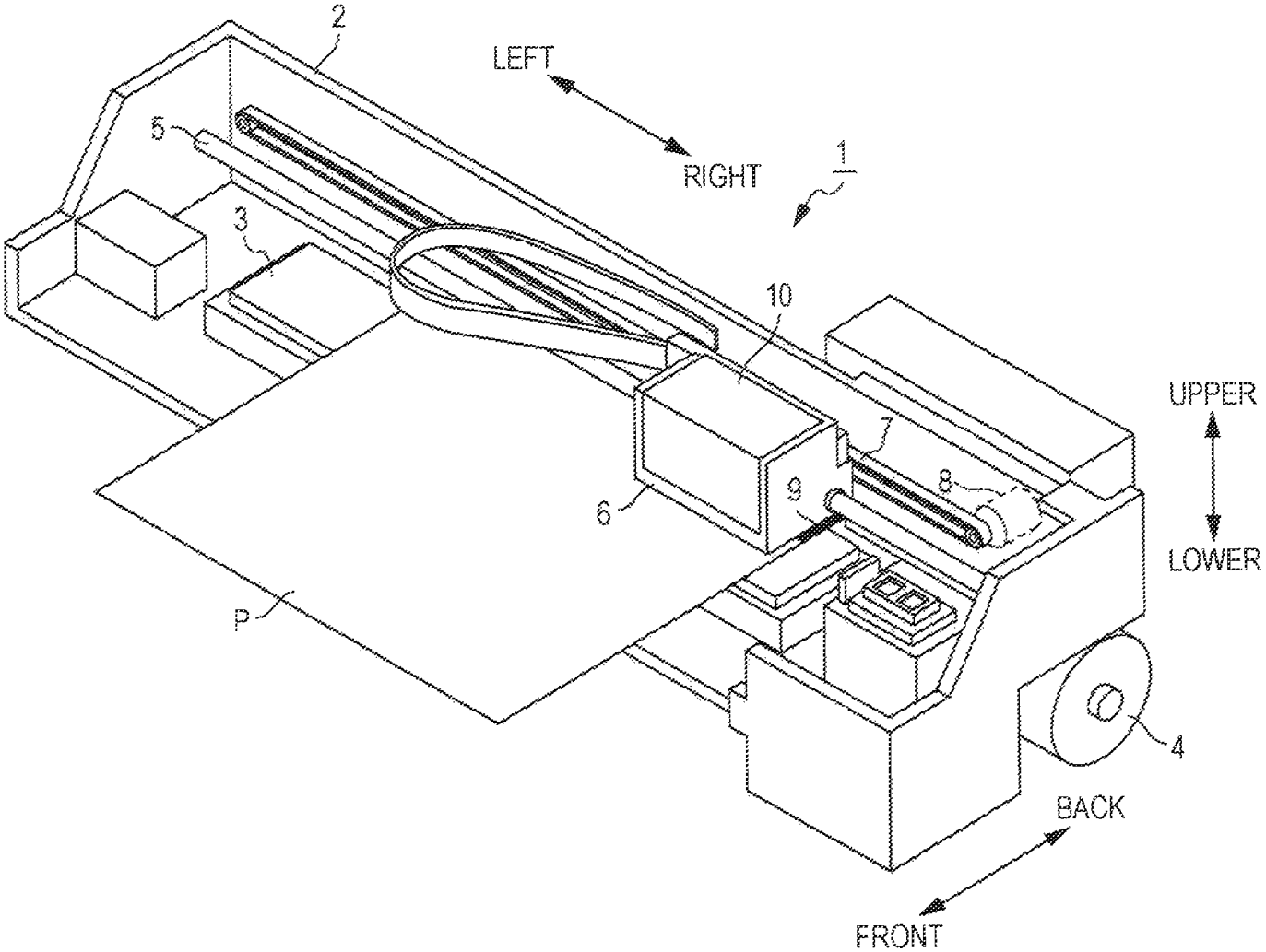
FIG. 1 is a schematic perspective view of an ink jet recording apparatus.

FIG. 1 is a schematic perspective view of the ink jet apparatus used in the embodiments described below.

As shown in FIG. 1, the ink jet apparatus is an ink jet printer (hereinafter referred to as printer) 1. The printer 1 is used as a recording apparatus and includes a frame 2. A platen 3 is disposed in the frame 2. A paper sheet P is fed over the platen 3 by the operation of a recording medium feed motor 4. The frame 2 is provided with a guide bar 5 parallel to the longitudinal direction of the platen 3.

The guide bar 5 holds a carriage 6 for reciprocal movement of the carriage 6 in the axis direction of the guide bar 5. The carriage 6 is connected to a carriage motor 8 through a timing belt 7 disposed within the frame 2. The carriage 6 is reciprocally moved along the guide bar 5 by the carriage motor 8.

The carriage 6 has a head 9. In the head 9, an ink cartridge 10 from which an ink, or liquid, is supplied is removably disposed. The ink in the ink cartridge 10 is supplied to the head 9 by the operation of a piezoelectric element (not shown) in the head 9, and is ejected onto the recording medium or paper sheet P over the platen 3 through a plurality of nozzles formed in a nozzle surface of the head 9. This structure produces recorded articles.

The ejection may be performed by a thermal jet method (bubble jet (registered trademark) method). Any ink jet technique may be applied.

Recording Medium

Exemplary recording media 110 include plane paper, special paper having an ink receiving layer or the like, and other sheets having a region, including the surface on which ink is applied, made of plastic, ceramic, glass, metal, or a composite of these materials. Preferably, the ink-applying surface of the recording medium 100 is made of plastic. Thus, the glitter of the glittering image 120 can be enhanced. If the recording medium 110 has an ink receiving layer, it is preferable that the recording medium also have a porous layer. The porous layer contains less than 30% of resin and inorganic particles that may have pores, so that liquid can penetrate spaces between the particles or the pores in the particles. The porous layer contributes to the enhancement of the glitter.

The recording medium may contain chlorine, and the chlorine may be intentionally added to the medium so as to increase the fixability of the color ink. Alternatively, the chlorine may be a trace amount of contaminant resulting from the residue of a chlorine-based bleach used for bleaching pulp, which is the raw material of paper. Hence, the chlorine content in the recording medium has a wide range from a ppm order level to about 1% by mass, and many of the recording media contain chlorine. The method of embodiments of the invention can form (record) images having high glitter, color developability and light fastness on recording media containing chlorine.

Glittering Ink

The glittering ink used in the embodiments of the invention contains silver particles having high glossiness (glitter) and low reactivity with water and organic solvents as a glittering material. The composition of the glittering ink containing silver will now be described.

(1) Silver Particles

As mentioned above, the glittering ink used in the embodiments of the invention contains silver particles. The presence of silver particles (particularly, together with a wax satisfying predetermined requirements) in the glittering ink allows the formation of images having high metallic gloss. In addition, since silver has the highest reflectance for visible light of the metals, metallic colors, such as gold and copper, can be produced by superimposition using a different color.

Preferably, the silver particles have an average particle size in the range of 3 to 100 nm, and more preferably in the range of 15 to 65 nm. Such silver particles can increase the feel of gloss (glitter) and the rub fastness of images formed with the glittering ink. Also, the ejection stability (accuracy of landing positions, stability of ejection quantity, etc.) of the ink ejected by an ink jet method can be enhanced, and consequently, images having desired quality can be more reliably formed over a long time. The term "average particle size" mentioned herein is on a volume basis unless otherwise specified. The average particle size can be measured with a particle size distribution analyzer based on a laser diffraction/scattering method. A particle size distribution meter using dynamic light scattering (for example, Microtrack UPA manufactured by Nikkiso Co., Ltd.) may be used as the laser diffraction/scattering particle size distribution analyzer.

The silver particle content in the glittering ink is preferably 0.5% to 30% by mass, and more preferably 5.0% to 15% by mass. Such an ink can be stably ejected by an ink jet method, and can be stably stored. Furthermore, the image of the record article has high quality and high rub fastness in a wide range of density from the case where the silver particle density (silver particle content) on the recording medium of the recorded article is low to the case where it is high.

The silver particles may be prepared in any process. For example, a solution containing silver ions is prepared, and the silver ions are reduced to silver in the presence of a dispersant.

(2) Dispersant

Since the specific gravity of silver is as high as 10.49 g/cm$^3$, silver particles of 100 nm or more in size settle easily in ink. On the other hand, if the particle size is 100 nm or less, the Brownian movement of the silver particles is increased, and accordingly, the settling in the ink of the particles is reduced, but the surface activity of the particles is increased. The particles form aggregates easily by contact with each other, and the aggregates settle. Accordingly, it is preferable that a dispersant be applied to the surfaces of the silver particles. Exemplary dispersants include, but are not limited to, polymeric compounds that can coordinate with silver, such as polyvinyl alcohol, polyvinyl pyrrolidone, and polyethylene glycol; hydroxy acids and their salts that can coordinate with silver, such as citric acid, malic acid, trisodium citrate, tripotassium citrate, trilithium citrate, triammonium citrate, disodium malate, tannic acid, gallotannic acid, and gallic tannin; and mercapto acids having a thiol group and a hydroxy group and their salts that can coordinate with silver, such as mercaptoacetic acid, mercaptopropionic acid, thiodipropionic acid, mercaptosuccinic acid, thioacetic acid, sodium mercaptoacetate, sodium mercaptopropionate, sodium thiodipropionate, disodium mercaptosuccinate, potassium mercaptoacetate, potassium mercaptopropionate, potassium thiodipropionate, and dipotassium mercaptosuccinate. These dispersants may be used singly or in combination. Among these, preferred are polymeric compounds that can coordinate with silver at a plurality of points, such as polyvinyl alcohol, polyacrylamine, and polyvinyl pyrrolidone. These compounds are advantageous from the viewpoint of preventing aggregation, and polyvinyl pyrrolidone is most advantageous from the viewpoint of storage stability of ink.

(3) Resin

The glittering ink may contain a resin. By adding a resin, the fixability and the rub fastness of the ink can be enhanced. Examples of the resin include, but are not limited to, polyacrylic acid, polymethacrylic acid, polymethacrylate ester, polyethylacrylic acid, styrene-butadiene copolymer, polybutadiene, acrylonitrile-butadiene copolymer, chloroprene copolymer, fluororesin, vinylidene fluoride, polyolefin resin, cellulose, styrene-acrylic acid copolymer, styrene-methacrylic acid copolymer, polystyrene, styrene-acrylamide copolymer, polyisobutyl acrylate, polyacrylonitrile, polyvinyl acetate, polyvinyl acetal, polyvinyl pyrrolidone, polyamide, rosin-based resins, fluorene-based resins, polyethylene, polycarbonate, vinylidene chloride resin, cellulose resins such as cellulose acetate butyrate, vinyl acetate resin, ethylene-vinyl acetate copolymer, vinyl acetate-acrylic copolymer, vinyl chloride resin, polyurethane, and rosin ester.

(4) Water

The glittering ink may be an aqueous ink containing 50% by mass or more of water or a non-aqueous ink whose water content is less than 50% by mass. Preferably, the aqueous ink containing 50% by mass or more of water is used. Since the solvent in the aqueous ink can be rapidly reduced on the recording medium, the fixability of the silver particles is enhanced.

If the ink contains water, the water functions mainly as a disperse medium that disperses silver particles and resin emulsion. By adding water to the ink, the dispersion stability of the silver particles can be enhanced, and the ink can be prevented from being undesirably dried (evaporation of disperse medium) around the nozzles of the liquid-ejecting apparatus, and can be rapidly dried on the recording medium after being applied. Accordingly, high-speed recording of desired images can be performed over a long time. If the ink contains water, the water content is preferably, but is not limited to, 20% to 80% by mass, and more preferably 50% to 70% by mass.

(5) Polyhydric Alcohol

Preferably, the glittering ink contains a polyhydric alcohol. In the use of the glittering ink in an ink jet recording apparatus, the polyhydric alcohol hinders the ink from drying and thus prevents the ink from clogging the ink jet recording head.

Exemplary polyhydric alcohols include ethylene glycol, diethylene glycol, triethylene glycol, polyethylene glycol, polypropylene glycol, propylene glycol, butylene glycol, 1,2,6-hexanetriol, thioglycol, hexylene glycol, glycerin, trimethylolethane, trimethylolpropane, 1,2-butanediol, 1,2-pentanediol, 1,2-hexanediol, 1,6-hexanediol, 1,2-heptanediol, and 1,2-octanediol. Among these, alkanediols having a carbon number of 4 to 8 are preferred, and those having a carbon number of 6 to 8 are more preferred. These polyhydric alcohols can enhance the penetration of the glittering ink into the recording medium. The polyhydric alcohol content in the glittering ink is preferably, but is not limited to, 0.1% to 20% by mass, and more preferably 0.5% to 10% by mass.

Preferably, the glittering ink contains 1,2-hexanediol or trimethylolpropane is selected from among the polyhydric alcohols cited above. These polyhydric alcohols can particularly enhance the dispersion stability of the silver particles in the glittering ink and the storage stability and ejection stability of the ink.

(6) Glycol Ether

Preferably, the glittering ink contains a glycol ether. Glycol ethers can increase the wettability to the recording surface of the recording medium to enhance the penetration of the ink.

Exemplary glycol ethers include lower alkyl ethers of polyhydric alcohols, such as ethylene glycol monomethyl ether, ethylene glycol monoethyl ether, ethylene glycol monobutyl ether, diethylene glycol monomethyl ether, diethylene glycol monoethyl ether, diethylene glycol monobutyl ether, dipropylene glycol monomethyl ether, dipropylene glycol monoethyl ether, triethylene glycol monomethyl ether, triethylene glycol monobutyl ether, and tripropylene glycol monomethyl ether. In particular, the use of triethylene glycol monobutyl ether leads to higher record quality. The glycol ether content in the glittering ink is preferably, but is not limited to, 0.2% to 20% by mass, and more preferably 0.3% to 10% by mass.

(7) Surfactant

The glittering ink may contain a surfactant. Any surfactant can be used, and, preferably, an acetylene glycol-based surfactant or a polysiloxane-based surfactant is used. Acetylene glycol-based and polysiloxane-based surfactants can increase the wettability to the recording surface of the recording medium and thus enhance the penetration of the ink.

Examples of the acetylene glycol-based surfactant include 2,4,7,9-tetramethyl-5-decyne-4,7-diol, 3,6-dimethyl-4-octyne-3,6-diol, 3,5-dimethyl-1-hexyne-3-ol, and 2,4-dimethyl-5-hexyne-3-ol. A commercially available acetylene glycol-based surfactant may be used, such as OLFINEs E1010, STG and Y (each produced by Nissin Chemical Industry); and SURFYNOLs 104, 82, 465, 485 and TG (each produced by Air Products and Chemicals Inc.)

The polysiloxane-based surfactant is commercially available as, for example, BYK-347 or BYK-348 (produced by BYK).

The glittering ink may contain other surfactants, such as anionic surfactants, nonionic surfactants, and amphoteric surfactants.

The surfactant content in the glittering ink is preferably, but is not limited to, 0.01% to 5.0% by mass, and more preferably 0.1% to 0.5% by mass.

(8) Other Constituents

The glittering ink may contain other constituents. Other constituents include, for example, a pH adjuster, a penetrant, an organic binder, a urea-based compound, a saccharide, a drying inhibitor, such as alkanolamine (e.g. triethanolamine), and an agent for increasing the slip property of glittering layers, such as paraffin.

(9) Properties of Glittering Ink

The glittering ink containing the above constituents (1) to (8) as needed preferably has a surface tension S (mN/m) of $20 \leq S \leq 40$, more preferably $25 \leq S \leq 35$, and a viscosity V (Pa·s) of $1.5 \leq V \leq 10$, more preferably $2.5 \leq V \leq 8$. Such a glittering ink can increase the feel of gloss (glitter) and the rub fastness of images. Also, the ejection stability (accuracy of landing positions, stability of ejection quantity, etc.) of ink ejected by an ink jet method can be enhanced, and consequently, images having desired quality can be more reliably formed over a long time.

The surface tension and viscosity mentioned herein are each a measurement of the ink at 23° C. unless otherwise specified. The surface tension can be measured by Wilhelmy method (plate method). For measuring surface tension by Wilhelmy method, a full-automatic surface tensiometer CBVP-Z (manufactured by Kyowa Interface Science) may be used, for example. The viscosity can be measured with a vibration viscometer. The vibration viscometer can calculate viscosity from a torque at which vibration can be kept constant when an oscillator is immersed in a liquid. A vibration viscometer VM-100A may be used as the vibration viscometer.

Protective Ink

The protective ink used in the embodiments of the invention contains a resin and substantially no coloring material. The protective ink may be an aqueous ink (containing 50% or more of water) or a non-aqueous ink (containing less than 50% of water). The phrase "containing substantially no coloring material" means that the coloring material content in the ink is, for example, less than 0.5%, preferably less than 0.1%, more preferably less than 0.01%, and further less than 0.005%. The coloring material mentioned herein refers to a pigment or a dye used for coloring.

(1) Resin

The protective ink used in the embodiments of the invention may contain the same resin as the resin described in (3) of the glittering ink. Among those, polyurethane and fluorene resins are preferred in view of light fastness, and furthermore, polyurethane is most suitable in view of the feel of gloss after applying the protective ink. The protective ink containing a resin imparts high light fastness to the glittering image. The resin content in the protective ink is preferably 0.1% to 30% by mass, more preferably 0.5% to 15% by mass, on a solid basis.

(2) Polyhydric Alcohol

The protective ink may contain the same polyhydric alcohol as the polyhydric alcohol described in (5) of the glittering ink. Preferably, the protective ink contains a polyhydric alcohol. In the use of the protective ink in an ink jet recording apparatus, the polyhydric alcohol hinders the ink from drying and thus prevents the ink from clogging the ink jet recording head.

(3) Glycol Ether

The protective ink may contain the same glycol ether as the glycol ether described in (6) of the glittering ink. Glycol ethers can increase the wettability to the recording surface of the recording medium and thus enhance the penetration of the ink. The glycol ether content in the protective ink is preferably, but is not limited to, 0.2% to 20% by mass, and more preferably 0.3% to 10% by mass.

(4) Surfactant

In the protective ink, any surfactant can be used, and, preferably, an acetylene glycol-based surfactant or a polysiloxane-based surfactant is used. The same acetylene glycol-base surfactants and polysiloxane-based surfactants as those described in (7) of the glittering ink may be cited as examples of the acetylene glycol-based and polysiloxane-based surfactants. Acetylene glycol-based and polysiloxane-based surfactants can increase the wettability to the recording surface of the recording medium and thus enhance the penetration of the ink. The surfactant content in the protective ink is preferably, but is not limited to, 0.01% to 5.0% by mass, and more preferably 0.1% to 0.5% by mass.

(5) Other Constituents

The protective ink may contain other constituents. Other constituents include, for example, a pH adjuster, a penetrant, an organic binder, a urea-based compound, a saccharide, a drying inhibitor, such as alkanolamine (e.g. triethanolamine), and an agent for increasing the slip property, such as paraffin.

Color Ink

The color ink used in the embodiments of the invention contains a coloring material. The color ink may be an aqueous ink (containing 50% or more of water) or a non-aqueous ink (containing less than 50% of water).

(1) Resin

The color ink used in the embodiments of the invention may contain the same resin as the resin described in (3) of the glittering ink. The use of the color ink containing a resin leads to a high rub fastness. The resin content in the color ink is preferably in the range of 4% to 50% by mass, more preferably in the range of 6% to 25% by mass, on a solid basis.

(2) Coloring Material (2-1) Pigment

Pigments may be used as the coloring material of the color ink, and the pigment may be, but is not limited to, an inorganic pigment or an organic pigment.

Exemplary inorganic pigments include carbon blacks, such as furnace black, lampblack, acetylene black, and channel black (for example, C. I. Pigment Black 7). Iron oxide and titanium oxide may also be used. Examples of pigments are as follows.

Exemplary organic pigments include insoluble azo pigments, such as insoluble azo pigments, condensed azo pigments, azo lake, and chelate azo pigments; polycyclic pigments, such as phthalocyanine pigments, perylene and perinone pigments, anthraquinone pigments, quinacridone pigments, dioxane pigments, thioindigo pigments, isoindolinone pigments, and quinophthalone pigments; dye chelates, such as basic dye chelates and acid dye chelates; dye lakes, such as basic dye lakes and acid dye lakes; and nitro pigments, nitroso pigments, aniline black, and daylight fluorescent pigments. These pigments may be used singly or in combination.

More specifically, inorganic pigments used for black color include: carbon blacks, such as No. 2300, No. 900, MCF88, No. 33, No. 40, No. 45, No. 52, MA7, MA8, MA100, and No. 2200B (each produced by Mitsubishi Chemical); Raven 5750, Raven 5250, Raven 5000, Raven 3500, Raven 1255, and Raven 700 (each produced by Columbia Carbon); Regal 400R, Regal 330R, Regal 660R, Mogul L, Monarch 700, Monarch 800, Monarch 880, Monarch 900, Monarch 1000, Monarch 1100, Monarch 1300, and Monarch 1400 (each produced by Cabot); and Color Black FW1, Color Black FW2, Color Black FW2V, Color Black FW18, Color Black FW200, Color Black 5150, Color Black S160, Color Black 5170, Printex 35, Printex U, Printex V, Printex 140U, Special Black 6, Special Black 5, Special Black 4A, and Special Black 4 (each produced by Degussa).

Organic pigments for yellow color include C. I. Pigment Yellows 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 167, 172 and 180.

Organic pigments for magenta color include C. I. Pigment Reds 1, 2, 3, 4, 5, 6, 7, 8, 9, 10, 11, 12, 14, 15, 16, 17, 18, 19, 21, 22, 23, 30, 31, 32, 37, 38, 40, 41, 42, 48(Ca), 48(Mn), 57(Ca), 57:1, 88, 112, 114, 122, 123, 144, 146, 149, 150, 166, 168, 170, 171, 175, 176, 177, 178, 179, 184, 185, 187, 202, 209, 219, 224 and 245, and C. I. Pigment Violets 19, 23, 32, 33, 36, 38, 43 and 50.

Organic pigments for cyan color include C. I. Pigment Blues 1, 2, 3, 15, 15:1, 15:2, 15:3, 15:4, 15:6, 15:34, 16, 18, 22, 25, 60, 65 and 66, and C. I. Vat Blues 4 and 60.

(2-2) Dye

If a dye is used, it may be selected from various types of dye generally used for ink jet recording, such as direct dyes, acid dyes, food dyes, basic dyes, reactive dyes, disperse dyes, vat dyes, soluble vat dyes, and reactive disperse dyes. The following dyes can be used.

Yellow dyes include C. I. Acid Yellows 1, 3, 11, 17, 19, 23, 25, 29, 36, 38, 40, 42, 44, 49, 59, 61, 70, 72, 75, 76, 78, 79, 98, 99, 110, 111, 127, 131, 135, 142, 162, 164 and 165, C. I. Direct Yellows 1, 8, 11, 12, 24, 26, 27, 33, 39, 44, 50, 58, 85, 86, 87, 88, 89, 98, 110, 132, 142 and 144, C. I. Reactive Yellows 1, 2, 3, 4, 6, 7, 11, 12, 13, 14, 15, 16, 17, 18, 22, 23, 24, 25, 26, 27, 37 and 42, C. I. Food Yellows 3 and 4, and C. I. Solvent Yellows 15, 19, 21, and 109.

Magenta dyes include C. I. Acid Reds 1, 6, 8, 9, 13, 14, 18, 26, 27, 32, 35, 37, 42, 51, 52, 57, 75, 77, 80, 82, 85, 87, 88, 89, 92, 94, 97, 106, 111, 114, 115, 117, 118, 119, 129, 130, 131, 133, 134, 138, 143, 145, 154, 155, 158, 168, 180, 183, 184, 186, 194, 198, 209, 211, 215, 219, 249, 252, 254, 262, 265, 274, 282, 289, 303, 317, 320, 321 and 322, C. I. Direct Reds 1, 2, 4, 9, 11, 13, 17, 20, 23, 24, 28, 31, 33, 37, 39, 44, 46, 62, 63, 75, 79, 80, 81, 83, 84, 89, 95, 99, 113, 197, 201, 218, 220, 224, 225, 226, 227, 228, 229, 230 and 231, C. I. Reactive Reds 1, 2, 3, 4, 5, 6, 7, 8, 11, 12, 13, 15, 16, 17, 19, 20, 21, 22, 23, 24, 28, 29, 31, 32, 33, 34, 35, 36, 37, 38, 39, 40, 41, 42, 43, 45, 46, 49, 50, 58, 59, 63 and 64, C. I. Solubilized Red 1, and C. I. Food Reds 7, 9 and 14.

Cyan dyes include C. I. Acid Blues 1, 7, 9, 15, 22, 23, 25, 27, 29, 40, 41, 43, 45, 54, 59, 60, 62, 72, 74, 78, 80, 82, 83, 90, 92, 93, 100, 102, 103, 104, 112, 113, 117, 120, 126, 127, 129, 130, 131, 138, 140, 142, 143, 151, 154, 158, 161, 166, 167, 168, 170, 171, 182, 183, 184, 187, 192, 199, 203, 204, 205, 229, 234, 236 and 249, C. I. Direct Blues 1, 2, 6, 15, 22, 25, 41, 71, 76, 77, 78, 80, 86, 87, 90, 98, 106, 108, 120, 123, 158, 160, 163, 165, 168, 192, 193, 194, 195, 196, 199, 200, 201, 202, 203, 207, 225, 226, 236, 237, 246, 248 and 249, C. I. Reactive Blues 1, 2, 3, 4, 5, 7, 8, 9, 13, 14, 15, 17, 18, 19, 20, 21, 25, 26, 27, 28, 29, 31, 32, 33, 34, 37, 38, 39, 40, 41, 43, 44 and 46, C. I. Solubilized Vat Blues 1, 5 and 41, C. I. Vat Blues 4, 29 and 60, C. I. Food Blues 1 and 2, and C. I. Basic Blues 9, 25, 28, 29 and 44.

The coloring material content in the color ink is preferably, but is not limited to, 1% to 20% by mass, and more preferably 1% to 10% by mass.

(3) Polyhydric Alcohol

The color ink used in the embodiments of the invention may contain the same polyhydric alcohol as the polyhydric alcohol described in (5) of the glittering ink. Preferably, the color ink contains a polyhydric alcohol. In the use of the color ink in an ink jet recording apparatus, the polyhydric alcohol hinders the ink from drying and thus prevents the ink from clogging the ink jet recording head.

(4) Glycol Ether

The color ink may contain the same glycol ether as the glycol ether described in (6) of the glittering ink. Glycol ethers can increase the wettability to the recording surface of the recording medium and thus enhance the penetration of the ink. The glycol ether content in the ink is preferably, but is not limited to, 0.2% to 20% by mass, and more preferably 0.3% to 10% by mass.

(5) Surfactant

In the color ink, any surfactant can be used, and, preferably, a fluorine-based surfactant, an acetylene glycol-based surfactant or a polysiloxane-based surfactant is used. The same acetylene glycol-base surfactants and polysiloxane-based surfactants as those described in (7) of the glittering ink may be cited as examples of the acetylene glycol-based and polysiloxane-based surfactants. Acetylene glycol-based and polysiloxane-based surfactants can increase the wettability to the recording surface of the recording medium and thus enhance the penetration of the ink. The surfactant content in the protective ink is preferably, but is not limited to, 0.01% to 5.0% by mass, and more preferably 0.1% to 0.5% by mass.

(6) Other Constituents

The color ink may contain other constituents. Other constituents include, for example, a pH adjuster, a penetrant, an organic binder, a urea-based compound, a saccharide, and a drying inhibitor, such as alkanolamine (e.g. triethanolamine).

Ink Jet Recording Method

In the known ink jet recording method, in order to form a color image having glitter, a color ink is directly applied by an ink jet method onto an image formed with a glittering ink by an ink jet method. However, if a glittering ink containing silver particles and a recording medium containing chlorine are used, the following problems are likely to occur. (1) The silver particles and the coloring material of the color ink are mixed because the glittering layer formed of the glittering ink is dispersed into the solvent of the color ink. Consequently, the resulting image cannot exhibit sufficient chromaticness or glitter. (2) Since the silver particles and a high-concentration color pigment come into direct contact with each other, the silver particles can react with the chlorine in the recording medium to produce silver chloride. In this instance, the silver chloride comes into contact with the coloring material and, consequently, the light fastness of the resulting recorded article is significantly degraded.

On the other hand, the method according to the embodiments of the invention can record images having high glitter, color developability and light fastness on recording media containing chlorine. Operations of the ink jet recording method of the embodiments will now be described.

Forming of Glittering Image

In this operation, a glittering image is recorded by ejecting the glittering ink containing silver onto a recording medium by an ink jet method. Thus, a glittering image is formed.

Forming of Color Image

In this operation, a color image is recorded over the glittering image by ejecting the color ink containing a coloring material by an ink jet method. Thus, a metallic color image is formed. The phrase "over the glittering image" means that the color image may be directly recorded on the glittering image, or may be recorded over the glittering image with a layer of the protective ink therebetween.

Applying of Protective Ink

In this operation, the protective ink containing a resin and substantially no coloring material is applied between the glittering image and the color image. Thus, a metallic color image having high light fastness can be formed. Any technique may be used for applying the protective ink. For example, an ink jet method may be used, or a known analogue coater may be used, such as a bar coater, a blade coater, a roll coater, a spray coater, or a slit coater.

Although the operation of applying the protective ink may be performed at any timing, it is preferable that the protective ink be applied after the completion of forming the glittering image. The protective ink may be applied before or simultaneously with the ejection of the color ink, as long as it is applied after the completion of the formation of the glittering image. More preferably, the protective ink is applied after the completion of the formation of the glittering image and before the formation of the color image (in other word, the protective ink does not ejected simultaneously with other inks). Also, since the effect of the color ink on the glittering ink depends on the coloring material, the ejection quantity per unit area of the protective ink in the overlap region with the color image may be varied depending on the type or content of the coloring material. For example, when the overlap region includes a region formed by mainly ejecting a magenta ink and a region formed by mainly ejecting a yellow ink, the ejection quantity per unit area of the protective ink may be varied between these regions. Thus, an image having high colorfulness as well as gloss and light fastness can be recorded (formed).

First Embodiment

The ink jet recording method according to a first embodiment will now be described. The drawings show conceptual structures, and the invention is not limited to these structures.

Forming of Glittering Image

Figure 2A:
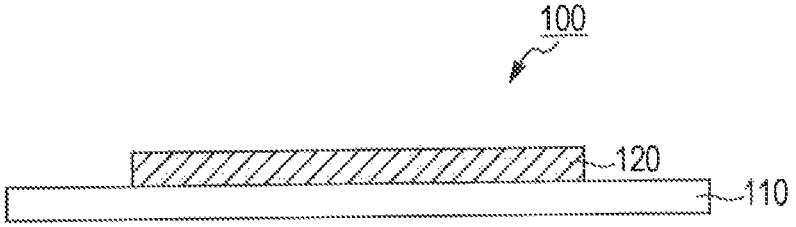
FIGS. 2A to 2C are sectional views of a recorded article that is being produced by an ink jet recording method according to a first embodiment of the invention.

In this operation, the glittering ink is applied onto one side of a recording medium 110 from an ink jet apparatus as described above to form a glittering image 120 on the recording medium 110, thus forming a first recorded article precursor 100, as shown in FIG. 2A.

Applying of Protective Ink

In this operation, a protective ink is applied onto the glittering image 120 of the first recorded article precursor 100 shown in FIG. 2A from an ink jet apparatus. Thus, a second recorded article precursor 101 including the glittering image 120 on the recording medium 110 and a protective layer 130 on the glittering image 120 is formed, as shown in FIG. 2B.

Forming of Color Image

Figure 2B:
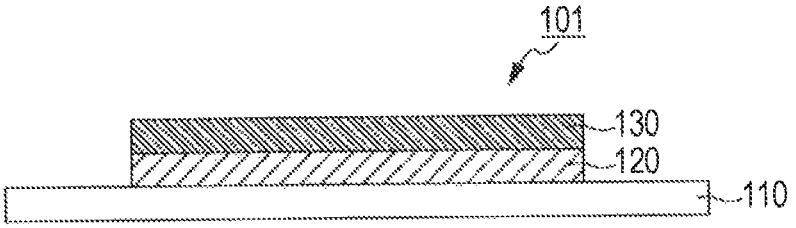
Figure 2C:
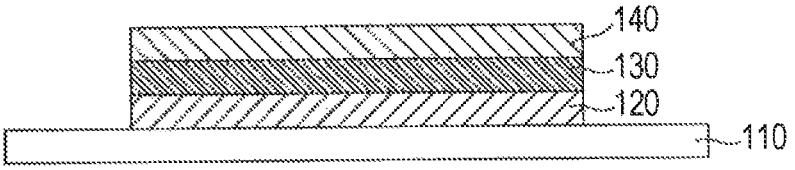

In this operation, the color ink is applied onto the second recorded article precursor 101 shown in FIG. 2B from an ink jet apparatus to form a color image 140 on the recording medium 110. Thus, a recorded article is formed, as shown in FIG. 2C, which includes the desired glittering image 120 and color image 140 formed on the recording medium.

For performing the above operations for forming the glittering image 120, applying the protective ink, and forming the color image 140, the recording medium 110 may be fed to the ink jet apparatus in each operation. Alternatively, nozzle liens of the ink jet head of the ink jet apparatus may be divided, in the direction of the transport of the recording medium 110, so that the three operations can be continuously performed by feeding the recording medium 110 to the ink jet apparatus once, into at most three portions: a first nozzle portion for forming the glittering image 120; a second nozzle portion for applying the protective ink; and a third nozzle portion for forming the color image 140.

From the viewpoint of positional accuracy of images to be recorded and simplicity of the process, it is preferable that the nozzle lines be divided for continuously performing the operations.

In the present embodiment, the protective ink is reliably applied between the glittering image 120 and the color image 140, and thus the resulting recorded article has a particularly high light fastness.

Second Embodiment

Forming of Glittering Image

Figure 3A:
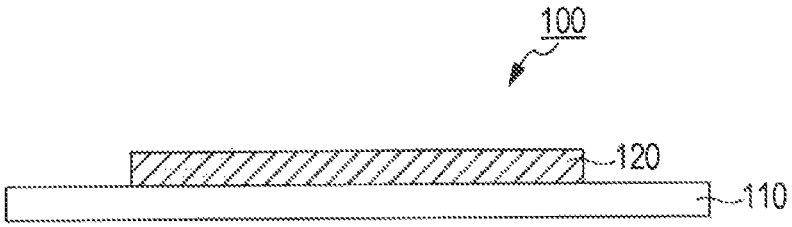
FIGS. 3A and 3B are sectional views of a recorded article that is being produced by an ink jet recording method according to a second embodiment of the invention.

In this operation, the glittering ink is applied onto one side of a recording medium 110 from an ink jet apparatus as described above to form a glittering image 120 on the recording medium 110, in the same manner as in the first embodiment, thus forming a first recorded article precursor 100, as shown in FIG. 3A.

Applying of Protective Ink and Forming of Color Image

Figure 3B:
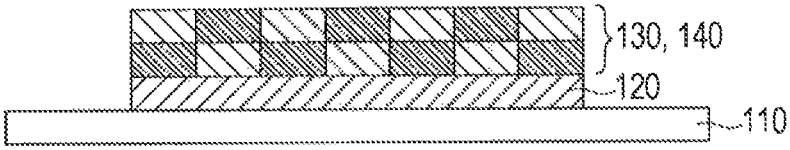

In this operation, the protective ink and the color ink are applied onto the glittering image 120 of the first recorded article precursor 100 shown in FIG. 3A from an ink jet apparatus. Thus, a recorded article is formed, as shown in FIG. 3B, which includes a protective layer 130 and a color image 140 that have been simultaneously recorded on the glittering image 120.

For performing the forming of the glittering image 120 and the simultaneous operation for applying the protective ink and forming a color image 140, the recording medium 110 may be fed to the ink jet apparatus in each operation. Alternatively, nozzle liens of the ink jet head of the ink jet apparatus may be divided, in the direction of the transport of the recording medium 110, so that the two operations can be continuously performed by feeding the recording medium 110 to the ink jet apparatus once, into two portions: a first nozzle portion for forming the glittering image 120; and a second nozzle portion for applying the protective ink and forming the color image 140.

From the viewpoint of positional accuracy of images to be recorded and simplicity of the process, it is preferable that the nozzle lines be divided for continuously performing the operations.

In the present embodiment, the protective ink and the color ink are simultaneously applied onto the glittering image 120, and a high light fastness is thus imparted to the recorded article. In addition, since the number of operations, or process steps, is reduced by one, the present embodiment is superior in productivity of recorded articles.

Third Embodiment

Forming of Glittering Image and Applying of Protective Ink

Figure 4A:
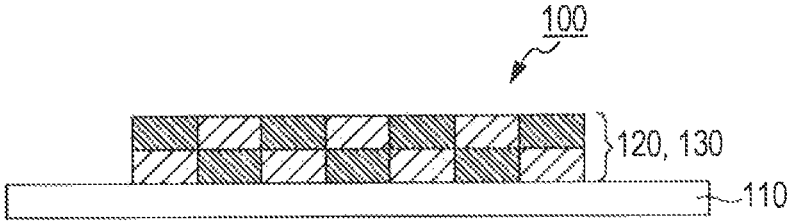
FIGS. 4A and 4B are sectional views of a recorded article that is being produced by an ink jet recording method according to a third embodiment of the invention.

In this operation, the glittering ink and the protective ink are simultaneously applied onto one side of a recording medium 110 as used in the first embodiment from an ink jet apparatus as described above to form a glittering image 120 and a protective layer 130 on the recording medium 110, thus forming a first recorded article precursor 100, as shown in FIG. 4A.

Forming of Color Image

Figure 4B:
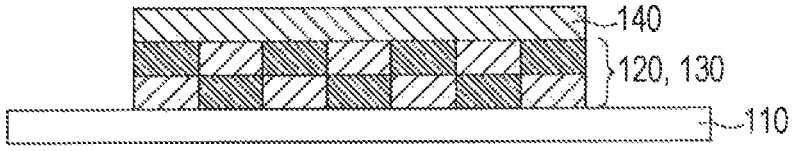

In this operation, the color ink is applied onto the glittering image 120 and protective layer 130 of the first recorded article precursor 100 from an ink jet apparatus. Thus, a recorded article is formed, as shown in FIG. 4B, which includes the color image 140 on the simultaneously recorded glittering image 120 and protective layer 130.

For performing the simultaneous operation for forming the glittering image 120 and applying the protective ink and the forming of the color image 140, the recording medium 110 may be fed to the ink jet apparatus in each operation. Alternatively, nozzle liens of the ink jet head of the ink jet apparatus may be divided, in the direction of the transport of the recording medium 110, so that the two operations can be continuously performed, into two portions: a first nozzle portion for forming the glittering image and applying the protective ink; and a second nozzle portion for forming the color image.

From the viewpoint of positional accuracy of images to be recorded and simplicity of the process, it is preferable that the nozzle lines be divided for continuously performing the operations.

In the present embodiment, the glittering ink and the protective ink are simultaneously applied, and a high light fastness is thus imparted to the recorded article. In addition, since the number of operations, or process steps, is reduced by one, the present embodiment is superior in productivity of recorded articles.

EXAMPLES

Examples of the invention will now be described.

(1) Preparation of Glittering Ink

Polyvinyl pyrrolidone (PVP, weight average molecular weight: 10000) was heated at 70° C. for 15 hours, and then cooled to room temperature. Into 500 mL of ethylene glycol, added was 1000 g of PVP to prepare a PVP solution. Into a different vessel containing 500 mL of ethylene glycol, 128 g of silver nitrate was added and sufficiently stirred with an electromagnetic stirrer to prepare a silver nitrate solution. The silver nitrate solution was added to the PVP solution with stirring with an overhead mixer at 120° C., and the mixture was heated at that temperature for 80 minutes to allow the reaction to proceed. The solution was then cooled to room temperature. The resulting solution was centrifuged at 2200 rpm for 10 minutes. Subsequently, separated silver particles were taken out, and 500 mL of ethanol was added for removing excess of the PVP. Centrifugation was further performed, and silver particles were taken out. The silver particles were dried at 35° C. and 1.3 Pa in a vacuum dryer.

To 8% by mass of silver particles prepared above, added were 3% by mass of 1,2-hexanediol, 0.3% by mass of triethanolamine, 4% by mass of trimethylolpropane, 4% by mass of polyvinyl pyrrolidone (PVP, k-15), 0.5% by mass of nonionic surfactant (OLFINE (registered trademark) E1010 produced by Nissin Chemical Industry), 0.1% by mass of paraffin-based wax (AQUACER (registered trademark) 539, produced by BYK), and ion exchanged water for adjusting the concentration, and thus a glittering ink was prepared. The average particle size of the silver particles, measured with Microtrac UPA (manufactured by Nikkiso) using spherical samples under the conditions of a particle refractive index of 0.2-3.9i and a solvent (water) refractive index of 1.333, was 20 nm.

(2) Color Ink

The following ink was used as the color ink: Magenta ink (ICM37, produced by Seiko Epson).

(3) Preparation of Protective Ink

Compositions 1 to 7

A fluorene resin and a urethane resin emulsion were added in proportions so as to prepare compositions 1 to 7 to a base composition containing 2% by mass of 1,2-hexanediol, 25% by mass of trimethylolpropane, 0.5% by mass of nonionic surfactant (OLFINE E1010, produced by Nissin Chemical Industry), 0.3% by mass of pH adjuster (triethanolamine), 0.01% by mass of benzotriazole, and 0.2% by mass of disodium ethylenediaminetetraacetate, and ion exchanged water was added as the balance of the compositions. The fluorene resin was synthesized by sufficiently mixing 30 parts by mass of isophorone diisocyanate, 50 parts by mass of 4,4'-(9-fluorenylidene)bis[2-(phenoxy)ethanol], 100 parts by mass of 3-hydroxy-2-(hydroxymethyl)-2-methylpropionic acid, and 30 parts by mass of triethylamine, and stirring the mixture at 120° C. in the presence of a catalyst for 5 hours. The resulting fluorene resin had a molecular weight of 3300 and contained 4,4'-(9-fluorenylidene)bis[2-(phenoxy)ethanol] in a monomer ratio of about 50% by mass.

(4) Forming of Recorded Article

Examples 1 to 24, Comparative Examples 1 to 10

Cartridges for an ink jet printer (PX-G930, manufactured by Seiko Epson) were charged with the glittering ink, the protective ink and the color ink. Then, a commercially available glossy paper containing chlorine (Photographic paper (Gloss), manufacture by Seiko Epson) was set in the printer.

Examples 1 to 12, Comparative Examples 3 and 4

Then, a first image was formed on the glossy paper with the glittering ink. Subsequently, the protective ink was applied onto the first image and, then, the color ink was applied on the protective ink, thus forming a second image, or the protective ink and the color ink were simultaneously applied onto the first image to form a second image. Thus, a recorded article including a glittering image and a color image was prepared.

Examples 13 to 18, Comparative Example 2

The above-described commercially available glossy paper (photographic paper (Gloss), manufactured by Seiko Epson) was set in the printer, and the glittering ink and the protective ink were simultaneously ejected from the ink jet head to form a first image on the glossy paper. Subsequently, a second image was formed on the first image with the color ink. Thus a recorded article including a glittering image and a color image was prepared.

Examples 19 to 24

The above-described commercially available glossy paper (photographic paper (Gloss), manufactured by Seiko Epson) was set in the printer, and a first image was formed on the glossy paper with the glittering ink. Subsequently, the protective ink was applied onto the first image and, then, the color ink was applied onto the protective ink, thus forming a second image. Thus, a recorded article including a glittering image and a color image was prepared.

Comparative Examples 5 to 10

The above-described commercially available glossy paper (photographic paper (Gloss), manufactured by Seiko Epson) was set in the printer, and a first image was formed on the glossy paper with the glittering ink. Subsequently, a second image was formed on the first image with the color ink. Thus, a recorded article including a glittering image and a color image was prepared. Then, the protective ink was applied over the glittering image and the color image.

Glittering Ink Composition

TABLE 1

| Glittering Ink Composition | |
|---|---|
| Constituent | Content (mass %) |
| 1,2-Hexanediol | 3 |
| Olefin E1010 | 0.5 |
| PVP | 4 |
| Trimethylolpropane | 4 |
| Triethanolamine | 0.3 |
| AQ539 | 0.1 |
| Silver pigment | 8 |
| Water | Balance |

Protective Ink Composition

TABLE 2

| Clear ink composition | | | | | | | |
|---|---|---|---|---|---|---|---|
| Constituent | Composition 1 (mass %) | Composition 2 (mass %) | Composition 3 (mass %) | Composition 4 (mass %) | Composition 5 (mass %) | Composition 6 (mass %) | Composition 7 (mass %) |
| 1,2-Hexanediol | 2 | 2 | 2 | 2 | 2 | 2 | 2 |
| Olefin E1010 | 0.5 | 0.5 | 0.5 | 0.5 | 0.5 | 0.5 | 0.5 |
| Trimethylolpropane | 25 | 25 | 25 | 25 | 25 | 25 | 25 |
| Triethanolamine | 0.3 | 0.3 | 0.3 | 0.3 | 0.3 | 0.3 | 0.3 |
| Benzotriazole | 0.01 | 0.01 | 0.01 | 0.01 | 0.01 | 0.01 | 0.01 |
| EDTA2Na | 0.02 | 0.02 | 0.02 | 0.02 | 0.02 | 0.02 | 0.02 |
| Fluorene resin | | 1.5 | 4 | 8 | | | |
| Urethane resin | | | | | 1.5 | 4 | 8 |
| Water | Balance | Balance | Balance | Balance | Balance | Balance | Balance |

Preparing Recorded Article Preparation Process and Evaluations for Gloss and Light Fastness

TABLE 3

| | | | Clear ink print timing | | | | | Silver magenta | | Evaluation | | |
|---|---|---|---|---|---|---|---|---|---|---|---|---|
| | Silver ink implantation quantity | Clear ink composition | Simultaneous with silver ink (D15) | Between silver and color inks (D40) | Simultaneous With Color inks (D15) | Between Silver And Color inks (D15) | Last (D40) | Initial gloss | Gloss degradation | Initial gloss | Gloss degradation | Comprehensive |
| Example 1 | 50 | 2 | | ● | | | | 201 | 3.0 | A | A | A |
| Example 2 | 50 | 2 | | | ● | | | 186 | −4.6 | B | B | B |
| Example 3 | 50 | 3 | | ● | | | | 192 | −0.7 | B | B | B |
| Example 4 | 50 | 3 | | | ● | | | 169 | −1.8 | B | B | B |
| Example 5 | 50 | 4 | | ● | | | | 199 | 3.0 | B | A | B |
| Example 6 | 50 | 4 | | | ● | | | 162 | −1.8 | B | B | B |
| Example 7 | 50 | 5 | | ● | | | | 214 | 0.3 | A | A | A |
| Example 8 | 50 | 5 | | | ● | | | 189 | −2.7 | B | B | B |
| Example 9 | 50 | 6 | | ● | | | | 191 | −0.5 | B | B | B |
| Example 10 | 50 | 6 | | | ● | | | 188 | −1.3 | B | B | B |
| Example 11 | 50 | 7 | | ● | | | | 151 | 2.4 | B | A | B |
| Example 12 | 50 | 7 | | | ● | | | 184 | −1.9 | B | B | B |

TABLE 3-continued

| | | | Clear ink print timing | | | | | Silver magenta | | Evaluation | | |
|---|---|---|---|---|---|---|---|---|---|---|---|---|
| | Silver ink implantation quantity | Clear ink composition | Simultaneous with silver ink (D15) | Between silver and color inks (D40) | Simultaneous With Color inks (D15) | Between Silver And Color inks (D15) | Last (D40) | Initial gloss | Gloss degradation | Initial gloss | Gloss degradation | Comprehensive |
| Example 13 | 50 | 2 | ● | | | | | 132 | 3.0 | C | A | C |
| Example 14 | 50 | 3 | ● | | | | | 111 | 4.5 | C | A | C |
| Example 15 | 50 | 4 | ● | | | | | 111 | 4.5 | C | A | C |
| Example 16 | 50 | 5 | ● | | | | | 144 | 0.0 | C | A | C |
| Example 17 | 50 | 6 | ● | | | | | 148 | −0.7 | C | B | C |
| Example 18 | 50 | 7 | ● | | | | | 126 | 0.7 | C | A | C |
| Example 19 | 50 | 2 | | | | ● | | 295 | −2.2 | A | B | B |
| Example 20 | 50 | 3 | | | | ● | | 288 | −6.9 | A | C | C |
| Example 21 | 50 | 4 | | | | ● | | 255 | −2.9 | A | B | B |
| Example 22 | 50 | 5 | | | | ● | | 287 | −3.7 | A | B | B |
| Example 23 | 50 | 6 | | | | ● | | 290 | −4.9 | A | B | B |
| Example 24 | 50 | 7 | | | | ● | | 278 | −2.5 | A | B | B |
| Comparative Example 1 | 50 | — | | | | | | 325 | −63.0 | A | D | D |
| Comparative Example 2 | 50 | 1 | ● | | | | | 312 | −62.6 | A | D | D |
| Comparative Example 3 | 50 | 1 | | ● | | | | 272 | −59.9 | A | D | D |
| Comparative Example 4 | 50 | 1 | | | ● | | | 270 | −73.2 | A | D | D |
| Comparative Example 5 | 50 | 1 | | | | | ● | 327 | −61.7 | A | D | D |
| Comparative Example 6 | 50 | 3 | | | | | ● | 207 | −15.0 | A | D | D |
| Comparative Example 7 | 50 | 4 | | | | | ● | 202 | −18.3 | A | D | D |
| Comparative Example 8 | 50 | 5 | | | | | ● | 169 | −22.2 | B | D | D |
| Comparative Example 9 | 50 | 6 | | | | | ● | 165 | −18.2 | B | D | D |
| Comparative Example 10 | 50 | 7 | | | | | ● | 131 | −13.0 | C | D | D |

Gloss
A: 200 or more
B: 150 or more and less than 200
C: 100 or more and less than 150
D: less than 100
Degradation
A: Not degraded
B: 0.1% or more and less than 5%
C: 5% or more and less than 10%
D: 10% or more
Comprehensive Whichever lower (5) Initial Gloss For the evaluation of initial gloss, the glossiness of the recorded article was measured at a tilt angle of 60° with a glossmeter MULTI GLOSS 268 (manufactured by Konica Minolta). The results were evaluated according to the following criteria:

A: Gloss≥200
B: 150≤Gloss<200
C: 100≤Gloss<150
D: Gloss<100

The results are shown in Table 3.

(6) Light Fastness

The light fastness was evaluated with a xenon light fastness tester according to JEITA CP-3901. More specifically, after two-month equivalent exposure test, the glossiness of the recorded article was measured at a tilt angle of 60° with a glossmeter MULTI GLOSS 268 (manufactured by Konica Minolta), and the rate of decrease in glossiness was evaluated according to the following criteria:

A: No decrease
B: 0.1%≤decrease<5%
C: 5%≤decrease<10%
D: decrease≥10%

The results are shown in Table 3.

(7) Comprehensive Evaluation of Recorded Article

Either initial gloss or light fastness, whichever is lower evaluation, was determined to be the comprehensive evaluation of the recorded article. The results are shown in Table 3.

Table 3 shows that the ink jet recording methods of embodiments of the invention can record (form) images having high gloss and high light fastness. On the other hand, the results of Comparative Examples were not satisfied.

What is claimed is:

1. An ink jet recording method comprising:

forming a glittering image on a recording medium by ejecting a glittering ink containing silver by an ink jet method;

applying a protective ink containing a resin and substantially no coloring material to the glittering image;

forming a color image by ejecting a color ink containing a coloring material to the glittering image by an ink jet method, wherein the protective ink is applied between the glittering image and the color image.

2. The ink jet recording method according to claim 1, wherein the applying of the protective ink is performed after the completion of the forming of the glittering image.

3. The ink jet recording method according to claim 2, wherein the applying of the protective ink is performed before the forming of the color image.

4. The ink jet recording method according to claim 1, wherein the amount of the protective ink applied is varied depending on the coloring material.

5. The ink jet recording method according to claim 1, wherein the resin in the protective ink is at least one selected from among urethane resins and fluorene resins.

6. The ink jet recording method according to claim 1, wherein the glittering ink contains 2% to 50% by mass of the silver, and has a surface tension S of 20 mN/m≤S≤40 mN/m and a viscosity V of 1.5 Pa·s≤V≤10 Pa·s.

7. The ink jet recording method according to claim 1, wherein the recording medium contains chlorine.

8. A recorded article produced by the ink jet recording method as set forth in claim 1.

9. A recorded article produced by the ink jet recording method as set forth in claim 2.

10. A recorded article produced by the ink jet recording method as set forth in claim 3.

11. A recorded article produced by the ink jet recording method as set forth in claim 4.

12. A recorded article produced by the ink jet recording method as set forth in claim 5.

13. A recorded article produced by the ink jet recording method as set forth in claim 6.

14. A recorded article produced by the ink jet recording method as set forth in claim 7.

* * * * *